US010178904B2

(12) United States Patent
Scavone

(10) Patent No.: US 10,178,904 B2
(45) Date of Patent: Jan. 15, 2019

(54) HAIR CLIP FOR INCREASING HAIR VOLUME AND CURL LIFT

(71) Applicant: Sheena Scavone, West Harrison, NY (US)

(72) Inventor: Sheena Scavone, West Harrison, NY (US)

( * ) Notice: Subject to any disclaimer, the term of this patent is extended or adjusted under 35 U.S.C. 154(b) by 271 days.

(21) Appl. No.: 15/070,848

(22) Filed: Mar. 15, 2016

(65) Prior Publication Data

US 2017/0265614 A1 Sep. 21, 2017

(51) Int. Cl.

| | |
|---|---|
| ***A45D 8/20*** | (2006.01) |
| ***A45D 8/24*** | (2006.01) |
| ***A45D 8/30*** | (2006.01) |
| *A45D 8/38* | (2006.01) |

(52) U.S. Cl.

CPC ..... *A45D 8/20* (2013.01); *A45D 8/24* (2013.01); *A45D 8/30* (2013.01); *A45D 8/38* (2013.01)

(58) Field of Classification Search

CPC ... A45D 8/20; A45D 8/24; A45D 8/30; A45D 8/32; Y10T 24/3431; Y10T 24/3936; Y10T 24/3433; Y10T 24/3443; Y10T 24/44376; Y10T 24/45251

USPC ..... 132/277

See application file for complete search history.

(56) References Cited

U.S. PATENT DOCUMENTS 3,250,282 A * 5/1966 Thatcher ..... A45D 8/20 132/277
4,763,390 A * 8/1988 Rooz ..... A47G 25/485 223/93
5,520,201 A * 5/1996 Hart ..... A45D 8/34 132/273
D404,525 S * 1/1999 Knudsen ..... D28/42
5,979,110 A * 11/1999 Tai ..... A01G 9/128 24/339
6,189,544 B1 * 2/2001 Potut ..... A45D 8/20 132/135
6,408,859 B1 * 6/2002 Shyu ..... A45D 8/20 132/276
D483,523 S * 12/2003 Jones ..... D28/40
7,559,125 B2 * 7/2009 Cofer ..... A61M 5/1418 24/487
D712,093 S * 8/2014 Hsu ..... D28/40
2006/0037626 A1 * 2/2006 Lane ..... A41G 5/0073 132/277
2009/0090379 A1 * 4/2009 Potut ..... A45D 8/22 132/277
2013/0192032 A1 * 8/2013 Huang ..... H02G 3/32 24/499

(Continued)

*Primary Examiner* — Jennifer Gill

(74) *Attorney, Agent, or Firm* — Leason Ellis LLP

(57) ABSTRACT

A hair clip, particularly for curly hair, includes a first curved jaw having a proximal end portion and a curved distal end portion; and a second curved jaw coupled to the first jaw. The second curved jaw has a proximal end portion and a curved distal end portion. An axle is coupled to the proximal end portions of the first and second curved jaws, thereby permitting the first and second curved jaws to pivot relative to one another between an open position and a closed position. The clip also has a biasing element disposed between the proximal end portions of the first and second curved jaws. The biasing element applies a biasing force to both the first and second curved jaws such that in a rest position, the first and second curved jaws are in the closed position.

15 Claims, 4 Drawing Sheets

(56) References Cited

U.S. PATENT DOCUMENTS

| | | | | |
|---|---|---|---|---|
| 2015/0020842 | A1* | 1/2015 | Park | A45D 8/20 132/279 |
| 2015/0250282 | A1* | 9/2015 | Hsu | A45D 8/20 132/277 |
| 2017/0181518 | A1* | 6/2017 | Hsu | A45D 8/20 |
| 2017/0215542 | A1* | 8/2017 | Han | A45D 8/20 |

* cited by examiner

HAIR CLIP FOR INCREASING HAIR VOLUME AND CURL LIFT

TECHNICAL FIELD

The present invention relates to hair care products and more particularly, relates to a hair clip that is particularly suited for curly hair and configured for increasing hair volume and root lift.

BACKGROUND

There are a wide number of hair accessory products commercially available and tailored to perform different functions. For example, one class of hair accessories is hair clips. As is known, hair clips generally comprise clasps for holding hair in place. They are often made from metal and/or plastics and sometimes feature decorative fabric.

Within the hair clip class, there are many different types of hair clips and these clips are used in different settings. For example, some hair clips are designed to be worn all day, while there are other hair clips that are only intended to be used during a hair treatment and more particularly, are used at home or a hair salon after the hair is washed and treated with hair products, such as shampoo, conditioner and the like.

As is also known, curly hair is often considered to be more challenging and harder to manage. There are therefore many products that are commercially marketed that are directed to treating and controlling curly hair, including products meant to increase hair volume, etc. Some of these products are in the form of hair clips that are designed to lift a curl grouping (of hair) in an effort to increase hair volume. Traditionally, these clips were in the form of a pair of flat jaws that are biased to allow the jaws to move between an open position in which the jaws are separated for receiving hair and a closed position in which the jaws are seated against one another. While these clips have some degree of effectiveness, there is a need for an improved hair clip that is configured to lift a hair grouping.

SUMMARY

A hair clip, particularly for curly hair, includes a first curved jaw having a proximal end portion and a curved distal end portion; and a second curved jaw coupled to the first jaw. The second curved jaw has a proximal end portion and a curved distal end portion. An axle is coupled to the proximal end portions of the first and second curved jaws, thereby permitting the first and second curved jaws to pivot relative to one another between an open position and a closed position. The clip also has a biasing element disposed between the proximal end portions of the first and second curved jaws. The biasing element applies a biasing force to both the first and second curved jaws such that in a rest position, the first and second curved jaws are in the closed position. The curved nature of the two jaws serves to lift a curl grouping away from the scalp, thereby maintaining the curl grouping and increase hair volume, etc.

BRIEF DESCRIPTION OF DRAWING FIGURES

DETAILED DESCRIPTION OF CERTAIN EMBODIMENTS

Figure 1:
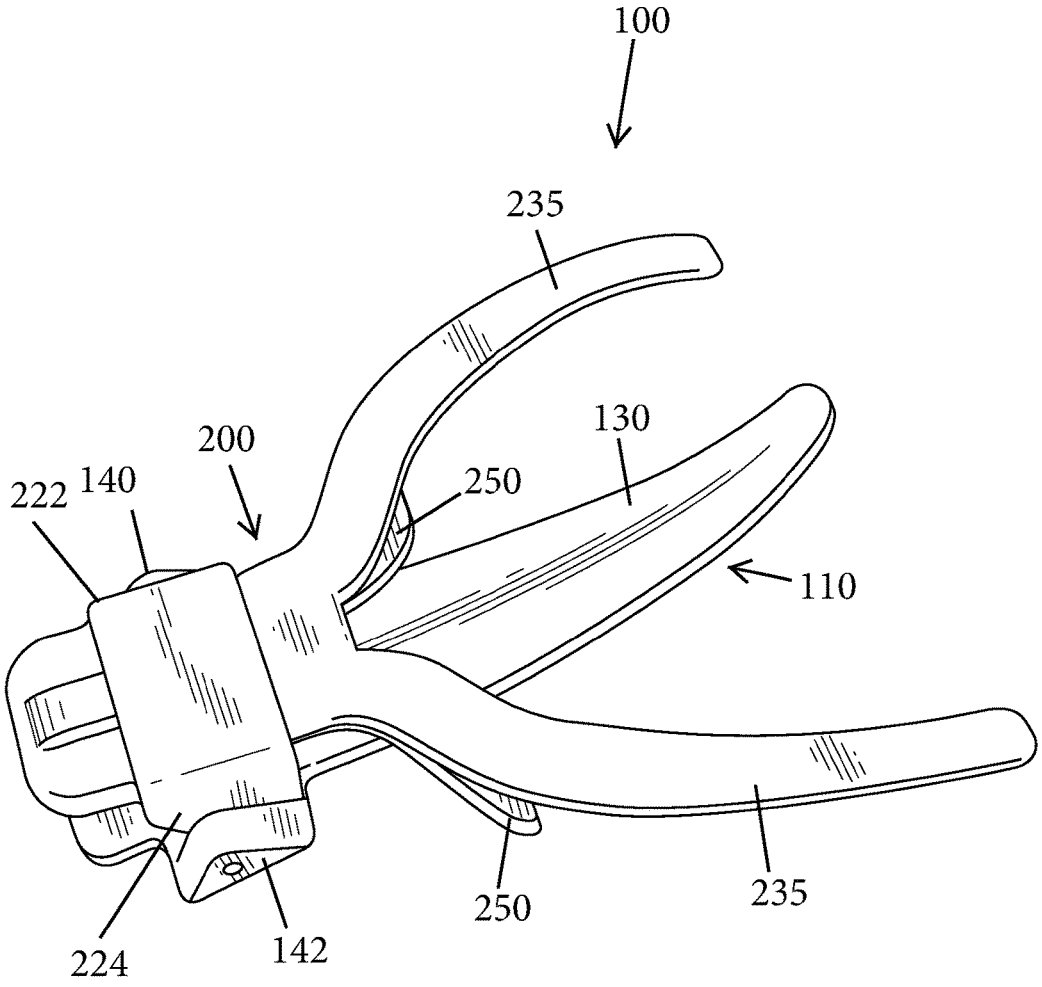
FIG. 1 is a bottom perspective view of a hair clip according to one exemplary embodiment of the present invention.
Figure 2:
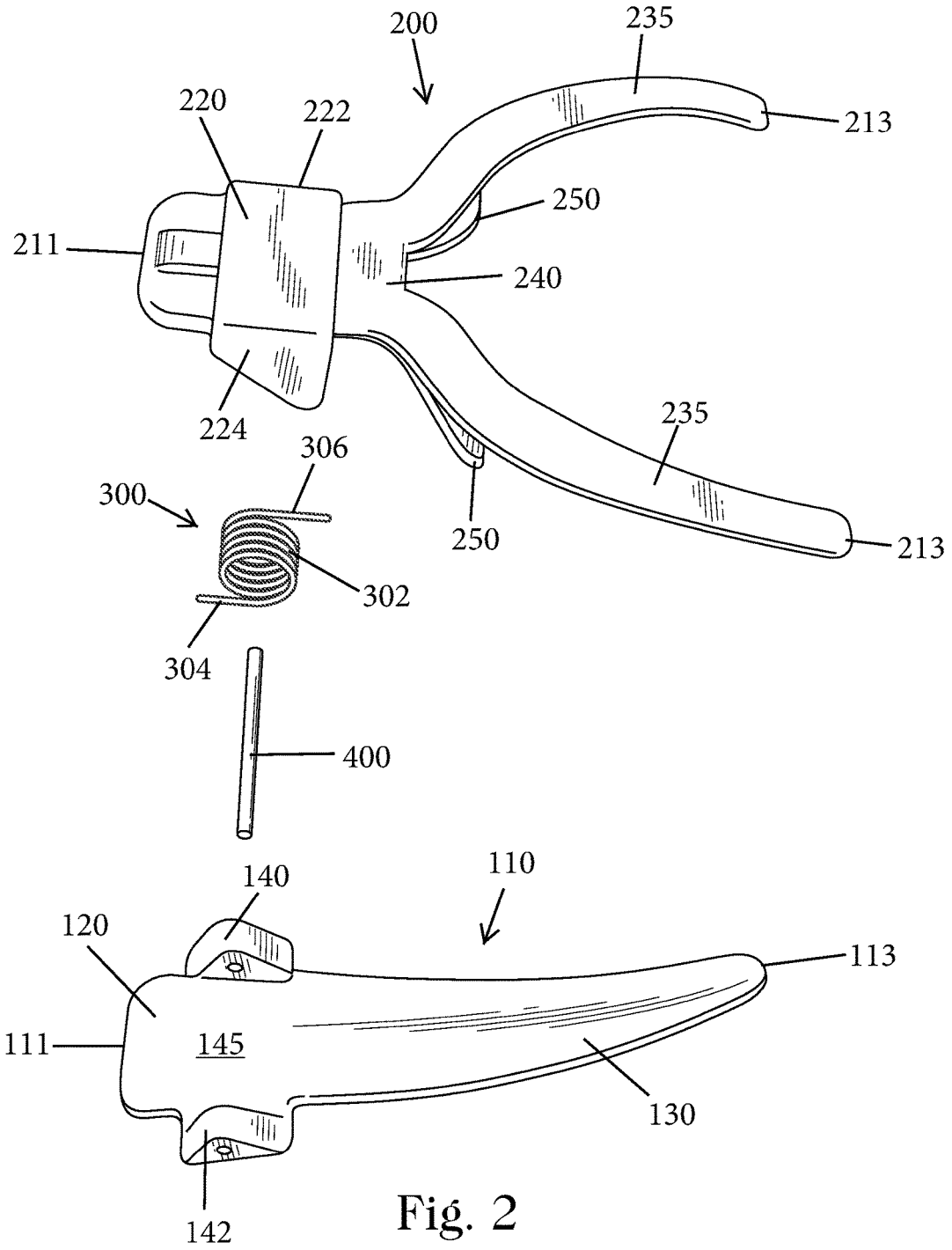
FIG. 2 is an exploded bottom perspective view of the hair clip of FIG. 1.
Figure 3:
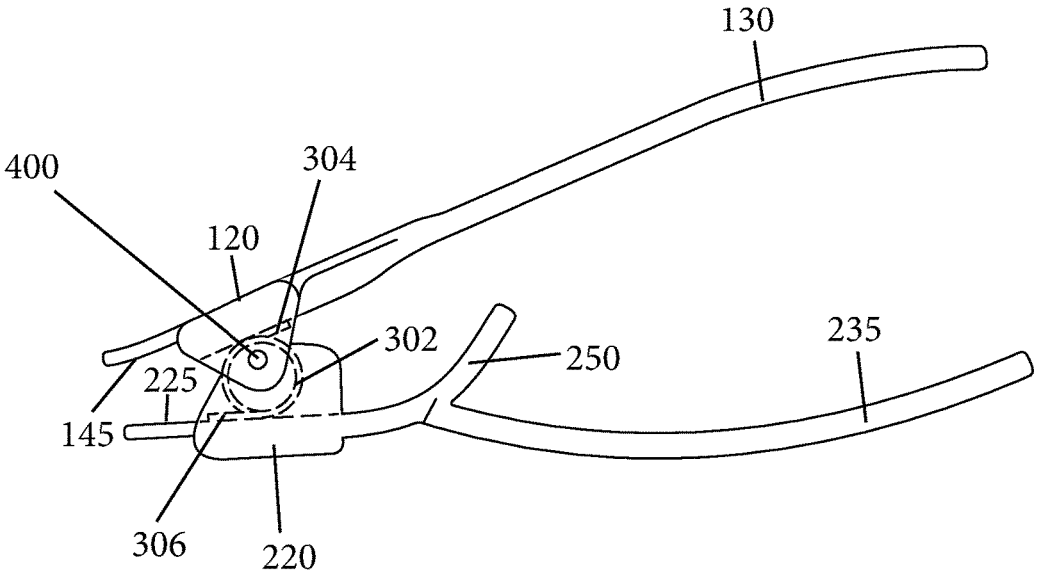
FIG. 3 is a side elevation view of the hair clip in an open position.

FIGS. 1-7 illustrate a hair clip 100 that is configured for use with curly hair and more particularly, is configured to increase the volume of the hair and lift the curls from the scalp. The hair clip 100 is formed of a first jaw 110 and a second jaw 200 that is coupled to the first jaw 110. As described herein, the first and second jaws 110, 200 are pivotally attached to one another to allow the hair clip 100 to move between an open position in which a hair grouping can be inserted between the first and second jaws 110, 200 and a closed position in which the inserted hair grouping is held between the first and second jaws 110, 200.

As described herein and illustrated in the figures, the first and second jaws 110, 200 are biased with a biasing element 300. The illustrated biasing element 300 is in the form of a torsion spring having a coiled portion 302 and a first leg 304 and a second leg 306. The first and second legs 304, 306 are spaced apart from one another with an angle being defined therebetween. As discussed below, the first leg 304 is in contact with and applies a biasing force to the first jaw 110 and the second leg 306 is in contact with and applies a biasing force to the second jaw 200. The torsion spring 300 ensures that in the rest position, the first and second jaws 110, 200 are closed relative to one another (i.e., the hair clip 100 is in the closed position) and in order to open the first and second jaws 110, 200 relative to one another, the user must overcome the biasing force of the torsion spring 300 resulting in pivoting of the first and second jaws 110, 200, whereby the torsion spring 300 is compressed.

The first jaw 110 is preferably an integral piece that can be made from different materials (e.g., metal or plastics) and by different techniques (e.g., casting or molding). The first jaw 110 has a first (proximal) end 111 and an opposing second (distal) end 113. At the first end 111, the first jaw 110 includes a first body portion 120 and a second body portion 130, in the form of an extension (elongated finger), extends outwardly from the first body portion 120. As shown, the second body portion 130 can be tapered toward the second end 113 and in particular, the second body portion 130 can be an inwardly tapered structure resulting in the second body portion 130 being narrower at the second end 113 than the opposite first end 111.

Also, as shown in the side elevation view of FIGS. 1-4, the second body portion 130 is curved in a first direction which is a direction toward the second jaw 200. The second body portion 130 can also be considered to be a finger structure.

The first body portion 120 includes first and second spaced walls 140, 142 with an open space 141 defined therebetween. The first and second spaced walls 140, 142 extend outwardly from a base surface 145 that extends therebetween and is part of the first body portion 120. The first and second spaced walls 140, 142 can be formed perpendicular to the base surface 145 and parallel to one another. The first and second spaced walls 140, 142 can have any number of different shapes and in the illustrated embodiment, the first and second spaced walls 140, 142 are generally triangular in shape. Along an underside of the base surface 145, a first leg 304 of the torsion spring 300 is seated and in particular, the underside can contain a recessed channel for receiving and containing the first leg 304.

The second jaw 200 is preferably an integral piece that can be made from different materials (e.g., metal or plastics) and by different techniques (e.g., casting or molding). The second jaw 200 has a first (proximal) end 211 and an opposing second (distal) end 213. At the first end 211, the second jaw 200 includes a first body portion 220 and a second body portion, in the form of a pair of extensions (fingers) 235, extends outwardly from the first body portion 220.

Unlike the single finger structure of the first jaw 110, the second jaw 200 has the pair of fingers 235 that are spaced apart from one another. As shown in the figures, the spacing between the pair of fingers 235 is such that the extension (finger) 130 of the first jaw 110 can be received therein between the pair of fingers 235. Unlike the tapered extension 130, each of the extensions 235 has a substantially uniform width along its length.

Also, as shown FIGS. 1-4, the second body portion 230 is curved in a second direction which is a direction toward the first jaw 110. Thus, the pair of extensions 235 are curved upwardly toward the extension 130, while the extension 130 is curved downwardly toward the pair of extensions 235.

The extensions 235 come together at a junction 240 which then leads to the first portion 210.

The second jaw 200 also includes a pair of upstanding protrusions or tabs 250 that act as stops as described below. The pair of tabs 250 are located at or proximate the junction 240 and are upwardly curved in a direction away from the extensions 235. The pair of tabs 250 are spaced apart from one another with the space defined therebetween being sized and shaped to receive the extension 130 of the first jaw 100. The portion of the extension (finger) 130 that extends through the space between the tabs 250 is a proximal end portion that is closer to the first portion 120 than the distal end 113 of the extension 130.

The degree of curvature (the slope) of the tabs 250 is greater than the degree of curvature (slope) of the extensions 235 and can be selected such that the height of the tabs 250 is greater than the height of the extensions 235. In other words, the distal end of the tabs 250 is above (slightly) the distal ends of the extensions 235. The tabs 250 also limit the movement of the first jaw 100 in that in the closed position (rest position), the first jaw 100 contacts the tabs 250.

The first body portion 120 includes first and second spaced walls 140, 142 with an open space 141 defined therebetween. The first and second spaced walls 140, 142 extend outwardly from a base surface 145 that extends therebetween and is part of the first body portion 120. The first and second spaced walls 140, 142 can be formed perpendicular to the base surface 145 and parallel to one another. The first and second spaced walls 140, 142 can have any number of different shapes and in the illustrated embodiment, the first and second spaced walls 140, 142 are generally triangular in shape. Along an underside of the base surface 145, the first leg 304 of the torsion spring 300 is seated and in particular, the underside can contain a recessed channel for receiving and containing the first leg 304.

Similarly, the first body portion 220 includes first and second spaced walls 222, 224 with an open space defined therebetween. The first and second spaced walls 222, 224 extend outwardly from a base surface 225 that extends therebetween and is part of the first body portion 120. The first and second spaced walls 222, 224 can be formed perpendicular to the base surface 225 and parallel to one another. The first and second spaced walls 222, 224 can have any number of different shapes and in the illustrated embodiment, the first and second spaced walls 222, 224 are generally triangular in shape. Along an underside of the base surface 225, a second leg 306 of the torsion spring 300 is seated and in particular, the underside can contain a recessed channel for receiving and containing the second leg 306.

The first and second legs 304, 306 of the torsion spring 300 applies biasing force to the first portions 120, 220 of the first and second jaws 110, 200 respectively. This biasing force repels the first portions 120, 220 from one another.

When the first jaw 110 is mated with the second jaw 200, the first and second spaced walls 222, 224, are disposed between the first and second spaced walls 140, 142 of the first body portion 120 of the first jaw 110. The first and spaced walls 222, 224 can pivot relative to the first jaw 110 and the first and second spaced walls 140, 142.

An axle 400 passes through holes formed in the first and second spaced walls 222, 224 and enters axially aligned holes formed in the first and second spaced walls 140, 142. The axle 400 passes through the center opening of the torsion spring 300. The axle 400 further couples the first and second jaws 110, 200 to one another and also allow for the controlled pivoting of the two jaws 110, 200 relative to one another.

The curvature of the extension 130 and the curvature of the two extensions 235 are selected such that in the closed position, the distal ends of the extension 130 are aligned and lie at least substantially within the same perpendicular plane in one embodiment.

Figure 4:
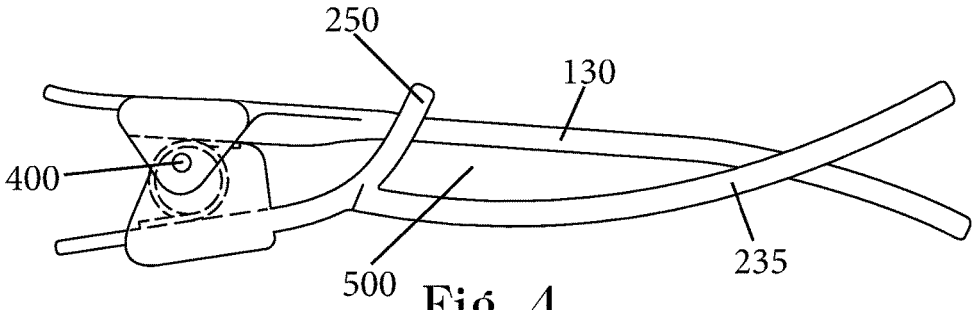
FIG. 4 is a side elevation view of the hair clip in a closed (rest) position.

As shown in FIG. 4, the location of the axle 400 is such that the first jaw 110 extends between the tabs 250 at locations that are close to the free top ends of the tabs 250. As also shown in FIG. 4, the curved nature of the first jaw 110, especially at the free distal end region thereof, causes the first jaw 110 to pass between the two extensions 235 of the second jaw 200 and be disposed below the two extensions 235. In other words, the curvatures of the distal end regions of the two jaws 110, 200 in opposite directions result in the jaws 110, 200 passing by one another with the first jaw 110 disposed between the extensions 235 of the jaw 200. In other words, as shown in FIG. 4, the first jaw 110 represents the top jaw at the proximal ends of the jaws 110, 200 where the jaws 110, 200 are attached in that the first jaw 110 lies above the second jaw 200, however, at the distal ends of the jaws 110, 200, the second jaw 200 lies above the first jaw 110. Thus, the jaws 110, 200 pass by one another but do not intersect one another.

From the side view shown in FIG. 4, when the jaws 110, 200 are in the closed position, the positioning of the jaw 110 relative to the jaw 200 defines a space 500 between the first and second jaws 110, 200. The space 500 is formed between the upstanding tabs 250 and the location at which the jaw 110 passes by the second jaw 200. Thus, not only in the open position, but also in the closed position, the space 500 exists between the two jaws 110, 200. This is in direct contrast to the conventional hair clips that have two jaws in which in the closed position, the two jaws 110, 200 seat flush against one another. This construction results in squishing of the hair between the two jaws. In contrast, in the present invention, the jaws 110, 200 are spaced apart from one another in both the open and closed positions.

Figure 5:
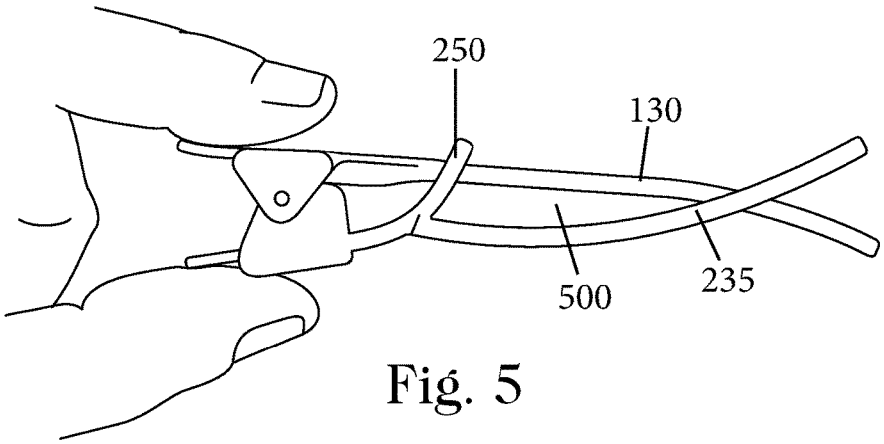
FIG. 5 is a side elevation view of the hair clip in the closed position prior to use.
Figure 6:
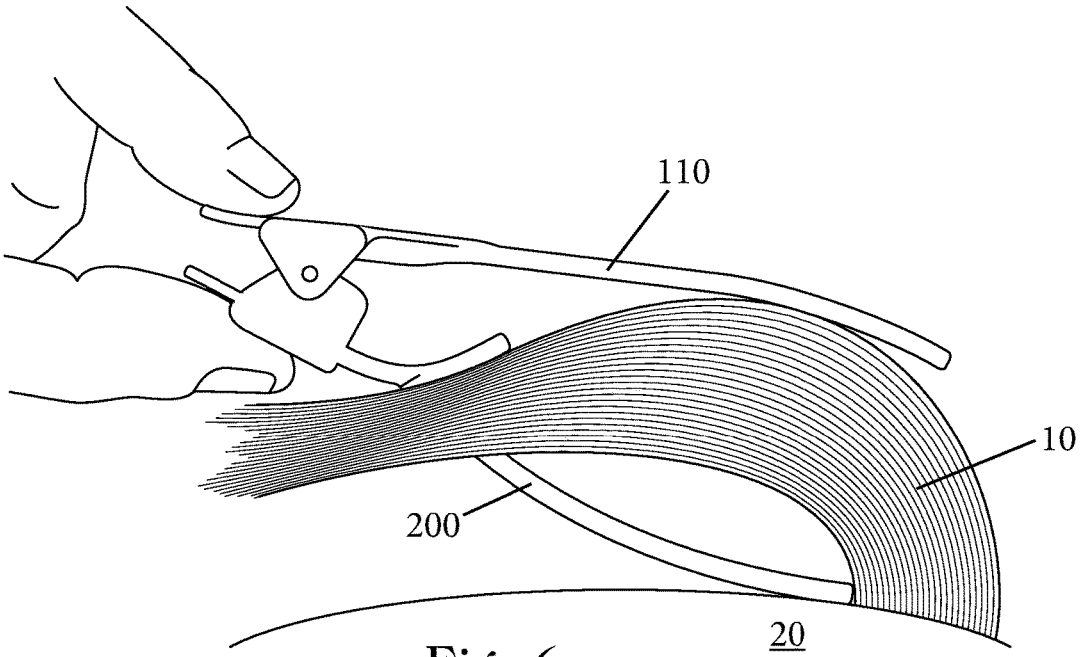
FIG. 6 is a side elevation view of the hair clip in the open position with a hair (curl) grouping being inserted between the open jaws of the hair clip.
Figure 7:
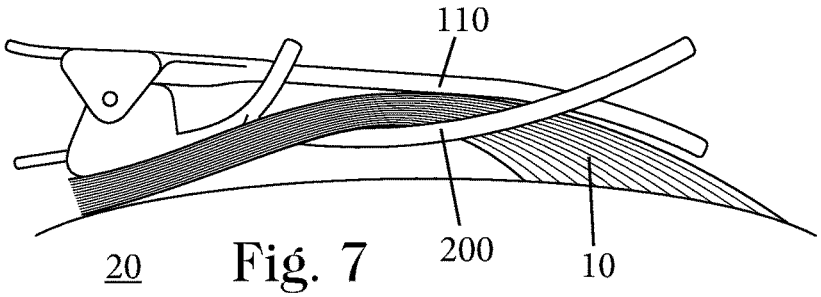
FIG. 7 is a side elevation view of the hair clip in the closed position and fixed to the hair grouping near the scalp.

FIGS. 5-7 show an exemplary use of the hair clip 100 to lift a hair grouping (curl grouping) 10 away from the scalp 20 to promote increased lifting of curls/increased hair volume, etc.

First, the hair 10 is cleansed and hydrated using conventional products, such as shampoo and conditioner, etc. The hair 10 is then typically at least partially dried as by using a towel (towel drying).

FIG. 6 shows the opening of the hair clip 100 by applying a force to the first and second jaws 110, 200. More specifically, the first portions 120, 220 of the respective jaws 110, 200 are pressed toward one another to cause pivoting of the jaws 110, 200 about the axle 400. This pivoting results in the opening of the jaws 110, 200 as shown in FIG. 6. Since the hair clip 100 is particularly intended for use with curly hair to promote curl lift/increasing hair volume, the hair clip 100 is position proximate the scalp 20. In particular, the second jaw 200 is positioned proximate the scalp 20 with the first jaw 110 being located further from the scalp 20. The curl grouping 10 is inserted into the open jaws 110, 200 between the upstanding tabs 250 and the distal end of the jaw 200. As mentioned herein, the upstanding tabs 250 act as a stop and prevents the hair grouping 10 from entering the area in which the torsion spring 300 is located. If the hair grouping 10 were to enter the torsion spring area, the hair grouping 100 could become tangled in the torsion spring 300 which would not be desired and could result in discomfort. FIG. 6 shows the upstanding tabs 250 acting as stops and limiting the movement of the hair grouping 10 in the direction toward the torsion spring 300.

Once the hair clip 100 is in the desired location and the hair grouping 10 which is intended to be lifted from the scalp 20, the force being applied to the jaws 110, 200 is removed (i.e., the user releases the proximal ends of the jaws 110, 200) and this results in the jaws 110, 200 moving back toward the closed position due the biasing force of the torsion spring 300 (FIG. 7). In this closed position, the hair grouping 10 is captured between the first and second jaws 110, 200 and is elevated from the scalp 20.

The hair clip 100 thus maintains the hair in an upright position as the hair grouping 10 dries and thus, the hair clip 100 is thus configured to increase volume and optimize hair definition and create root lift.

According to one exemplary embodiment, the hair clip 100 is positioned at the root of the curl and the hair clip 100 holds the hair grouping 10 up while it dries. Once removed, the result is increase volume at the roots of the curls.

What is claimed is:

1. A hair clip comprising:

a first curved jaw having a proximal end portion and a curved distal end portion;

a second curved jaw coupled to the first jaw, the second curved jaw having a proximal end portion and a curved distal end portion;

an axle coupled to the proximal end portions of the first and second curved jaws, thereby permitting the first and second curved jaws to pivot relative to one another between an open position and a closed position; and a biasing element disposed between the proximal end portions of the first and second curved jaws, the biasing element applying a biasing force to both the first and second curved jaws such that in a rest position, the first and second curved jaws are in the closed position;

wherein the first curved jaw comprises a single first elongated finger and the second curved jaw comprises a pair of second elongated fingers, with the single first elongated finger being disposed between the pair of second elongated fingers;

wherein the hair clip further includes first and second upstanding tabs that extend outwardly from the pair of second elongated fingers and are completely separate and spaced apart from one another, the single first elongated finger passing between the first and second upstanding tabs in the closed position;

wherein a center of the first upstanding tab lies in a same longitudinal plane as one of the pair of second elongated fingers and a center of the second upstanding tab lies in a same longitudinal plane as the other of the pair of second elongated fingers and the first and second upstanding tabs are curved in a same direction as the pair of second elongated fingers as measured from a proximal end to a distal end of the first and second upstanding tabs and from a proximal end to a distal end of the pair of the second elongated fingers and wherein in the closed position, the first elongated finger and second elongated fingers are free of contact with one another, with the first elongated finger being in contact with the pair of upstanding tabs.

2. The hair clip of claim 1, wherein the single first elongated finger is curved at a distal end thereof and each of the second elongated fingers is curved at a distal end thereof.

3. The hair clip of claim 1, wherein the curved distal end portion of the first curved jaw is curved in a direction toward the second curved jaw and the curved distal end portion of the second curved jaw is curved in a direction toward the first curved jaw.

4. The hair clip of claim 1, wherein the proximal end portion of the first curved jaw includes a pair of first side walls that are spaced apart from one another and define a first space therebetween and the proximal end portion of the second curved jaw includes a pair of second side walls that are spaced apart from one another and define a second space therebetween, wherein in an assembled condition, the second side walls are disposed internally between the first side walls with the axle passing through axially aligned bores formed in each of the first and second side walls.

5. The hair clip of claim 4, wherein the biasing element is disposed between the second side walls and is in contact with a face of the proximal end portion of the first curved jaw and a face of the proximal end portion of the second curved jaw, thereby applying the biasing force to each of the first and second curved jaws.

6. The hair clip of claim 1, wherein the biasing element comprises a torsion spring.

7. The hair clip of claim 5, wherein the biasing element comprises a torsion spring with a first leg being seated against the face of the proximal end portion of the first curved jaw and a second leg being seated against the face of the proximal end portion of the second curved jaw.

8. The hair clip of claim 1, wherein the first and second upstanding tabs are integrally formed with the pair of second elongated fingers at locations proximate the proximal end portions of the pair of second elongated fingers.

9. The hair clip of claim 8, wherein a degree of curvature of each of the first and second upstanding tabs is greater than a degree of curvature of each of the second elongated fingers.

10. The hair clip of claim 1, wherein the first and second upstanding tabs define stops for a grouping of hair placed between the first and second curved jaws in the open position to at least restrict the grouping of hair from contacting the biasing element.

11. The hair clip of claim 1, wherein in the closed position, the proximal end portion of the first curved jaw lies above the proximal end portion of the second curved jaw, while the curved distal end portion of the first curved jaw lies below the curved distal end portion of the second curved jaw.

12. The hair clip of claim 1, wherein a width of each of the first and second upstanding tabs is at least substantially equal to a width of an underlying portion of the respective second elongated finger.

13. The hair clip of claim 1, wherein a width of the single first elongated finger progressively decreases in a direction toward a distal end thereof and a width of each of the second elongated finger progressively decreases in a direction toward a distal end thereof.

14. The hair clip of claim 1, wherein in the closed position, a top edge of each of the upstanding tabs lies above the single first elongated finger.

15. The hair clip of claim 1, wherein the pair of second elongated fingers flares outwardly such that a distance between distal ends of the pair of second elongated fingers is greater than a distance between proximal ends of the pair of second elongated fingers.

* * * * *